US007880639B2

(12) United States Patent
Courtney et al.

(10) Patent No.: US 7,880,639 B2
(45) Date of Patent: Feb. 1, 2011

(54) METHOD OF ESTABLISHING COMMUNICATION WITH WIRELESS CONTROL DEVICES

(75) Inventors: Brian Michael Courtney, Bethlehem, PA (US); Lawrence R. Carmen, Jr., Bath, PA (US); Justin Mierta, Allentown, PA (US); Daniel Curtis Raneri, Bethlehem, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 1183 days.

(21) Appl. No.: 11/470,408

(22) Filed: Sep. 6, 2006

(65) Prior Publication Data

US 2008/0136663 A1 Jun. 12, 2008

(51) Int. Cl.

| | |
|---|---|
| ***G08C 19/00*** | (2006.01) |
| ***G08B 5/22*** | (2006.01) |
| ***G08B 5/00*** | (2006.01) |

(52) U.S. Cl. ..... 340/825.69; 340/815.45; 340/815.4; 340/825.72

(58) Field of Classification Search ..... 340/815.45, 340/815.4, 825.69, 825.72; 315/294, 194; 455/305, 90.1, 11.1; 343/866, 867
See application file for complete search history.

(56) References Cited

U.S. PATENT DOCUMENTS

| | | | | |
|---|---|---|---|---|
| 4,114,099 | A * | 9/1978 | Hollander | 348/734 |
| 4,529,980 | A * | 7/1985 | Liotine et al. | 340/825.52 |
| 4,864,588 | A | 9/1989 | Simpson et al. | |
| 4,932,037 | A | 6/1990 | Simpson et al. | |
| 4,995,053 | A | 2/1991 | Simpson et al. | |
| 5,239,205 | A | 8/1993 | Hoffman et al. | |
| 5,340,954 | A | 8/1994 | Hoffman et al. | |
| 5,365,551 | A | 11/1994 | Snodgrass et al. | |
| 5,375,254 | A | 12/1994 | Owen | |
| 5,454,077 | A | 9/1995 | Cheron | |

(Continued)

FOREIGN PATENT DOCUMENTS

| | | |
|---|---|---|
| EP | 0 767 551 | 4/1997 |

(Continued)

OTHER PUBLICATIONS

Eriksson, H. et al. "Performance of dynamic channel allocation in the DECT system" May 19, 1991, 1991 IEEE 41ts Vehicular Technology Conference, St. Louis, May 19-22, 1991.

(Continued)

*Primary Examiner*—Brian A. Zimmerman
*Assistant Examiner*—Nam V Nguyen
(74) *Attorney, Agent, or Firm*—Ostrolenk Faber LLP

(57) ABSTRACT

The method of the present invention allows a first wireless control device that is operable to communicate on a predetermined one of a plurality of channels to establish communication with a second wireless control device that may be communicating on any of the plurality of channels. A beacon message is first transmitted repeatedly by the wireless control device on the predetermined channel. The second wireless control device listens for the beacon message for a predetermined amount of time on each of the plurality of channels. When the second control device receives the beacon message on the predetermined channel, the second control device begins communicating on the predetermined channel. The second wireless device may begin listening for the beacon message in response to powering up.

13 Claims, 6 Drawing Sheets

U.S. PATENT DOCUMENTS

| | | | | |
|---|---|---|---|---|
| 5,467,266 | A | 11/1995 | Jacobs et al. | |
| 5,671,387 | A | 9/1997 | Jacobs et al. | |
| 5,736,965 | A | 4/1998 | Mosebrook et al. | |
| 5,818,128 | A | 10/1998 | Hoffman et al. | |
| 5,838,226 | A | 11/1998 | Houggy et al. | |
| 5,848,054 | A | 12/1998 | Mosebrook et al. | |
| 5,905,442 | A | 5/1999 | Mosebrook | |
| 5,982,103 | A | 11/1999 | Mosebrook et al. | |
| 6,175,201 | B1 | 1/2001 | Sid | |
| 6,181,255 | B1 * | 1/2001 | Crimmins et al. | 340/825.69 |
| 6,275,476 | B1 | 8/2001 | Wood, Jr. | |
| 6,324,089 | B1 | 11/2001 | Symoen et al. | |
| 6,388,399 | B1 | 5/2002 | Eckel et al. | |
| 6,535,109 | B1 | 3/2003 | Mahdavi | |
| 6,661,336 | B1 | 12/2003 | Atkins et al. | |
| 6,687,487 | B1 | 2/2004 | Mosebrook et al. | |
| 6,803,728 | B2 | 10/2004 | Balasubramaniam | |
| 6,812,843 | B2 * | 11/2004 | Soto et al. | 340/572.4 |
| 6,819,223 | B2 | 11/2004 | Amtmann | |
| 6,831,562 | B2 | 12/2004 | Rodgers et al. | |
| 6,831,569 | B2 | 12/2004 | Wang et al. | |
| 6,856,236 | B2 | 2/2005 | Christensen et al. | |
| 6,876,294 | B1 | 4/2005 | Regan | |
| 6,879,806 | B2 | 4/2005 | Shorty | |
| 6,901,439 | B1 | 5/2005 | Bonasia | |
| 6,901,542 | B2 | 5/2005 | Bartenstein et al. | |
| 6,927,547 | B2 | 8/2005 | Walko, Jr. et al. | |
| 6,975,206 | B2 | 12/2005 | Reining | |
| 6,980,080 | B2 | 12/2005 | Christensen et al. | |
| 6,983,783 | B2 | 1/2006 | Carmen, Jr. et al. | |
| 7,031,735 | B2 * | 4/2006 | Koshino | 455/500 |
| 7,054,616 | B2 * | 5/2006 | Rickhoff et al. | 455/411 |
| 7,085,627 | B2 | 8/2006 | Bamberger et al. | |
| 7,102,502 | B2 | 9/2006 | Autret | |
| 7,106,261 | B2 | 9/2006 | Nagel | |
| 7,123,140 | B1 | 10/2006 | Denes | |
| 7,126,291 | B2 | 10/2006 | Kruse et al. | |
| 7,130,584 | B2 * | 10/2006 | Hirvonen | 455/41.2 |
| 7,155,296 | B2 | 12/2006 | Klasson et al. | |
| 7,193,504 | B2 | 3/2007 | Carrender et al. | |
| 7,211,968 | B2 | 5/2007 | Adamson et al. | |
| 7,219,141 | B2 | 5/2007 | Bonasia et al. | |
| 7,253,717 | B2 | 8/2007 | Armstrong et al. | |
| 7,307,542 | B1 | 12/2007 | Chandler et al. | |
| 7,346,016 | B2 | 3/2008 | Nielsen et al. | |
| 7,447,498 | B2 * | 11/2008 | Chuey et al. | 455/418 |
| 7,486,172 | B2 | 2/2009 | Martinez et al. | |
| 7,498,924 | B2 | 3/2009 | Scherabon | |
| 2002/0043938 | A1 | 4/2002 | Lys | |
| 2002/0046226 | A1 | 4/2002 | Nakabe et al. | |
| 2002/0049822 | A1 | 4/2002 | Burkhardt et al. | |
| 2002/0126020 | A1 | 9/2002 | Wang et al. | |
| 2002/0140379 | A1 | 10/2002 | Chevalier et al. | |
| 2002/0154025 | A1 | 10/2002 | Ling | |
| 2003/0040813 | A1 | 2/2003 | Gonzales et al. | |
| 2003/0109270 | A1 | 6/2003 | Shorty | |
| 2004/0051467 | A1 | 3/2004 | Balasubramaniam | |
| 2004/0158624 | A1 | 8/2004 | Bodin et al. | |
| 2004/0250964 | A1 | 12/2004 | Carmen et al. | |
| 2005/0102040 | A1 | 5/2005 | Kruse et al. | |
| 2005/0280598 | A1 | 12/2005 | Webb et al. | |
| 2006/0002110 | A1 | 1/2006 | Dowling et al. | |
| 2006/0071757 | A1 | 4/2006 | Burghard et al. | |
| 2006/0125426 | A1 | 6/2006 | Veskovic | |
| 2006/0171332 | A1 | 8/2006 | Barnum | |
| 2006/0174102 | A1 | 8/2006 | Smith et al. | |
| 2006/0273970 | A1 | 12/2006 | Mosebrook et al. | |
| 2006/0284734 | A1 | 12/2006 | Newman, Jr. | |
| 2007/0076650 | A1 | 4/2007 | Manjeshwar et al. | |
| 2007/0126555 | A1 | 6/2007 | Bandy | |
| 2007/0139164 | A1 | 6/2007 | O'Toole et al. | |
| 2007/0159305 | A1 | 7/2007 | Cesar et al. | |
| 2007/0200677 | A1 | 8/2007 | Murano | |
| 2008/0055073 | A1 | 3/2008 | Raneri | |
| 2008/0068126 | A1 | 3/2008 | Johnson | |
| 2008/0068204 | A1 | 3/2008 | Carmen | |
| 2008/0089266 | A1 | 4/2008 | Orsat | |
| 2008/0092075 | A1 | 4/2008 | Jacob | |
| 2008/0111491 | A1 | 5/2008 | Spira | |
| 2008/0125057 | A1 | 5/2008 | Nass et al. | |
| 2009/0201135 | A1 | 8/2009 | Kawamura et al. | |

FOREIGN PATENT DOCUMENTS

| | | |
|---|---|---|
| EP | 0 767 551 A | 4/1997 |
| EP | 1 513 376 | 3/2005 |
| EP | 1 693 991 A1 | 8/2006 |
| GB | 2410867 | 8/2005 |
| JP | 03-244954 | 10/1991 |
| JP | 2003-087403 | 3/2003 |
| WO | WO 97/29467 | 8/1997 |
| WO | WO 01/52515 | 7/2001 |
| WO | WO 02/071689 | 9/2002 |
| WO | WO 03/007665 | 1/2003 |
| WO | WO 2006/046104 | 5/2006 |
| WO | 2006/099422 | 9/2006 |

OTHER PUBLICATIONS

Z-Wave Alliance Day Technical Seminar Slides from www.z-wavealliance.com, Jun. 14, 2005, 32 sheets.

Zensys A/S, Z-Wave Protocol Overview, Document No. SDS10243, Version 2, Apr. 24, 2006, 20 pages.

* cited by examiner

METHOD OF ESTABLISHING COMMUNICATION WITH WIRELESS CONTROL DEVICES

BACKGROUND OF THE INVENTION

1. Field of the Invention

The present invention relates to load control systems for controlling electrical loads and more particularly to a method of establishing communication in a radio frequency (RF) lighting control system between two or more RF control devices that may be communicating on different frequencies.

2. Description of the Related Art

Control systems for controlling electrical loads, such as lights, motorized window treatments, and fans, are known. Such control systems often use radio frequency (RF) transmission to provide wireless communication between the control devices of the system. Examples of RF lighting control systems are disclosed in commonly-assigned U.S. Pat. No. 5,905,442, issued on May 18, 1999, entitled METHOD AND APPARATUS FOR CONTROLLING AND DETERMINING THE STATUS OF ELECTRICAL DEVICES FROM REMOTE LOCATIONS, and commonly-assigned U.S. Pat. No. 6,803,728, issued Oct. 12, 2004, entitled SYSTEM FOR CONTROL OF DEVICES. The entire disclosures of both patents are hereby incorporated by reference.

The RF lighting control system of the '442 patent includes wall-mounted load control devices, table-top and wall-mounted master controls, and signal repeaters. The control devices of the RF lighting control system include RF antennas adapted to transmit and receive the RF signals that provide for communication between the control devices of the lighting control system. The control devices all transmit and receive the RF signals on the same frequency. Each of the load control devices includes a user interface and an integral dimmer circuit for controlling the intensity of an attached lighting load. The user interface has a pushbutton actuator for providing on/off control of the attached lighting load and a raise/lower actuator for adjusting the intensity of the attached lighting load. The table-top and wall-mounted master controls have a plurality of buttons and are operable to transmit RF signals to the load control devices to control the intensities of the lighting loads.

To prevent interference with other nearby RF lighting control systems located in close proximity, the RF lighting control system of the '442 patent preferably utilizes a house code (i.e., a house address), which each of the control devices stores in memory. It is particularly important in applications such as high-rise condominiums and apartment buildings that neighboring systems each have their own separate house code to avoid a situation where neighboring systems attempt to operate as a single system rather than as separate systems. Accordingly, during installation of the RF lighting control system, a house code selection procedure is employed to ensure that a proper house code is selected. In order to accomplish this procedure, one repeater of each system is selected as a "main" repeater. The house code selection procedure is initialized by pressing and holding a "main" button on the selected one repeater in one of the RF lighting control systems. The repeater randomly selects one of 256 available house codes and then verifies that no other nearby RF lighting control systems are utilizing that house code. The repeater illuminates a light-emitting diode (LED) to display that a house code has been selected. This procedure is repeated for each neighboring RF lighting control system. The house code is transmitted to each of the control devices in the lighting control system during an addressing procedure described below.

Collisions between transmitted RF communication signals may occur in the RF lighting control system when two or more control devices attempt to transmit at the same time. Accordingly, each of the control devices of the lighting control system is assigned a unique device address (typically one byte in length) for use during normal operation. The device addresses are unique identifiers that are used by the devices of the control system to distinguish the control devices from each other during normal operation. The device addresses allow the control devices to transmit the RF signals according to a communication protocol at predetermined times to avoid collisions. The house code and the device address are typically included in each RF signal transmitted in the lighting control system. Further, the signal repeaters help to ensure error-free communication by repeating the RF communication signals such that every component of the system receives the RF signals intended for that component.

After the house code selection procedure is completed during installation of the lighting control system, an addressing procedure, which provides for assignment of the device addresses to each of the control devices, is executed. In the RF lighting control system described in the '442 patent, the addressing procedure is initiated at a repeater of the lighting control system (e.g., by pressing and holding an "addressing mode" button on the repeater), which places all repeaters of the system into an "addressing mode." The main repeater is responsible for assigning device addresses to the RF control devices (e.g., master controls, wall-mounted load control devices, etc.) of the control system. The main repeater assigns a device address to an RF control device in response to a request for an address sent by the control device.

To initiate a request for the address, a user moves to one of the wall-mounted or table-top control devices and presses a button on the control device (e.g., an on/off actuator of the wall-mounted load control devices). The control device transmits a signal associated with the actuation of the button. This signal is received and interpreted by the main repeater as a request for an address. In response to the request for address signal, the main repeater assigns and transmits a next available device address to the requesting control device. A visual indicator is then activated to signal to the user that the control device has received a system address from the main repeater. For example, lights connected to a wall-mounted load control device, or an LED located on a master control, may flash. The addressing mode is terminated when a user presses and holds the addressing mode button of the repeater, which causes the repeater to issue an exit address mode command to the control system.

Some prior art RF lighting control systems are operable to communicate on one of a plurality of channels (i.e., frequencies). An example of such a lighting control system is described in the aforementioned U.S. Pat. No. 6,803,728. The signal repeater of such a lighting control system is operable to determine the quality of each of the channels (i.e., determine the ambient noise on each of the channels), and to choose a select one of the channels for the system to communicate on. An unaddressed control device communicates with the signal repeater on a predetermined addressing frequency in order to receive the device address and the selected channel. However, if there is a substantial amount of noise on the predetermined addressing frequency, the control devices may not communicate properly with the repeater and configuration of the control devices may be hindered. Therefore, it is desirable to allow the RF lighting control system to communicate on the selected channel during the configuration procedure.

SUMMARY OF THE INVENTION

According to the present invention, a method of establishing communication with a control device operable to be coupled to a source of power and operable to communicate on a plurality of channels comprises the steps of: (1) transmitting a beacon signal repeatedly on a predetermined channel; (2) the control device listening for the beacon signal for a predetermined amount of time on each of the plurality of channels; (3)the control device receiving the beacon signal on the predetermined channel; and (4) the control device communicating on the predetermined channel.

The present invention further provides a method for configuring a radio frequency control device capable of receiving radio frequency messages on a plurality of radio frequency channels from a first device so as to receive messages transmitted by the first device on a designated one of the radio frequency channels. The method comprises the steps of: (1) a beacon message transmitting device transmitting a beacon message on one of the channels; (2) initiating a beacon monitoring mode at the control device; (3) the control device listening for the beacon message by scanning each of the plurality of radio frequency channels for a period of time; (4) the control device receiving the beacon message on one of the channels; (5) the control device locking on to the one of plurality of channels on which the beacon message is received; and (6) the control device halting further listening in response to the steps of receiving and locking on.

In addition, the present invention provides a control system operable to communicate on a designated radio frequency channel from amongst a plurality of radio frequency channels. The system comprises a beacon message transmitting device and a control device. The beacon message transmitting device is operable to transmit a beacon message on one of the plurality of radio frequency channels. The control device is operable to receive a first transmitted signal on any of the plurality of radio frequency channels, and to monitor for the beacon message on each of the plurality of radio frequency channels for a predetermined period of time until the beacon message is received by the control device on one of the plurality of channels. The control device is further operable to lock on to the one of the plurality of channels on which the beacon message is received, and to subsequently halt further monitoring for the beacon message.

Other features and advantages of the present invention will become apparent from the following description of the invention that refers to the accompanying drawings.

DETAILED DESCRIPTION OF THE INVENTION

Figure 1:
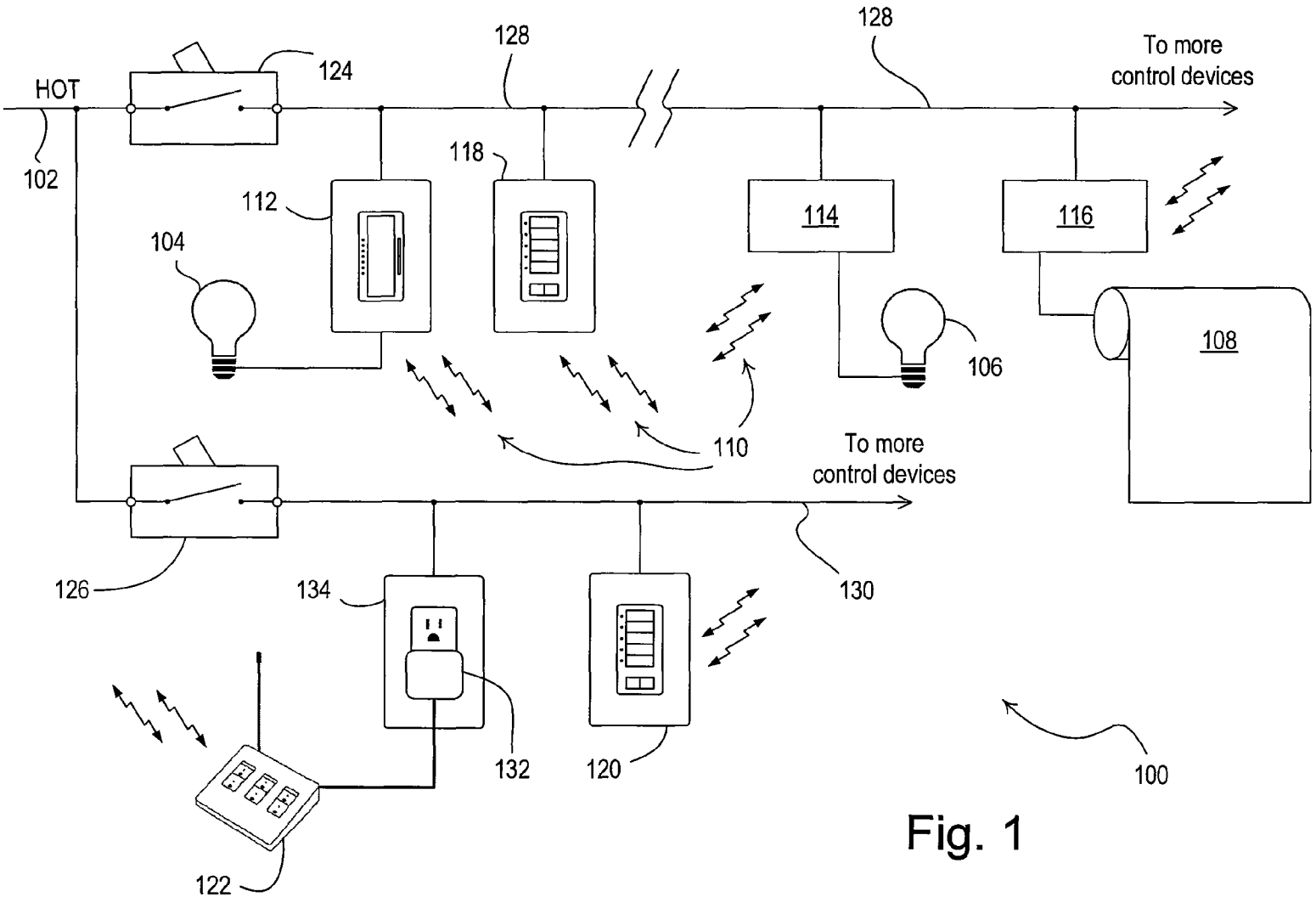
FIG. 1 is a simplified block diagram of an RF lighting control system according to the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of an RF lighting control system 100 according to the present invention. The RF lighting control system 100 is operable to control the power delivered from a source of AC power to a plurality of electrical loads, for example, lighting loads 104, 106 and a motorized roller shade 108. The RF lighting control system 100 includes a HOT connection 102 to a source of AC power for powering the control devices and the electrical loads of the lighting control system. The RF lighting control system 100 utilizes an RF communication link for communication of RF signals 110 between control devices of the system.

The lighting control system 100 comprises a wall-mounted dimmer 112 and a remote dimming module 114, which are operable to control the intensities of the lighting loads 104, 106, respectively. The remote dimming module 114 is preferably located in a ceiling area, i.e., near a lighting fixture, or in another remote location that is inaccessible to a typical user of the lighting control system 100. A motorized window treatment (MWT) control module 116 is coupled to the motorized roller shade 108 for controlling the position of the fabric of the roller shade and the amount of daylight entering the room. Preferably, the MWT control module 116 is located inside the roller tube of the motorized roller shade 108, and is thus inaccessible to the user of the system.

A first wall-mounted master control 118 and a second wall-mounted master control 120 each comprise a plurality of buttons that allow a user to control the intensity of the lighting loads 104, 106 and the position of the motorized roller shade 108. In response to an actuation of one of the buttons, the first and second wall-mounted master controls 118, 120 transmit RF signals 110 to the wall-mounted dimmer 112, the remote dimming module 114, and the MWT control module 116 to control the associated loads.

Preferably, the control devices of the lighting control system 100 are operable to transmit and receive the RF signals 110 on a plurality of channels (i.e., frequencies). A repeater 122 is operable to determine a select one of the plurality of channels for all of the control devices to utilize. For example, 60 channels, each 100 kHz wide, are available in the United States. The repeater 122 also receives and re-transmits the RF signals 110 to ensure that all of the control devices of the lighting control system 100 receive the RF signals. Each of the control devices in the RF lighting control system comprises a serial number that is preferably six bytes in length and is programmed in a memory during production. As in the prior art control systems, the serial number is used to uniquely identify each control device during initial addressing procedures.

The lighting control system 100 further comprises a first circuit breaker 124 coupled between the HOT connection 102 and a first power wiring 128, and a second circuit breaker 126 coupled between the HOT connection 102 and a second power wiring 130. The wall-mounted dimmer 112, the first wall-mounted master control 118, the remote dimming module 114, and the MWT control module 116 are coupled to the first power wiring 128. The repeater 122 and the second wall-mounted master control 120 are coupled to the second power wiring 130. The repeater 122 is coupled to the second power wiring 130 via a power supply 132 plugged into a wall-mounted electrical outlet 134. The first and second circuit breakers 124, 126 allow power to be disconnected from the control devices and the electrical loads of the RF lighting control system 100.

The first and second circuit breakers 124, 126 preferably include manual switches that allow the circuit breakers to be reset to the closed position from the open position. The manual switches of the first and second circuit breakers 124, 126 also allow the circuit breakers to be selectively switched to the open position from the closed position. The construction and operation of circuit breakers is well known and, therefore, no further discussion is necessary.

Figure 2:
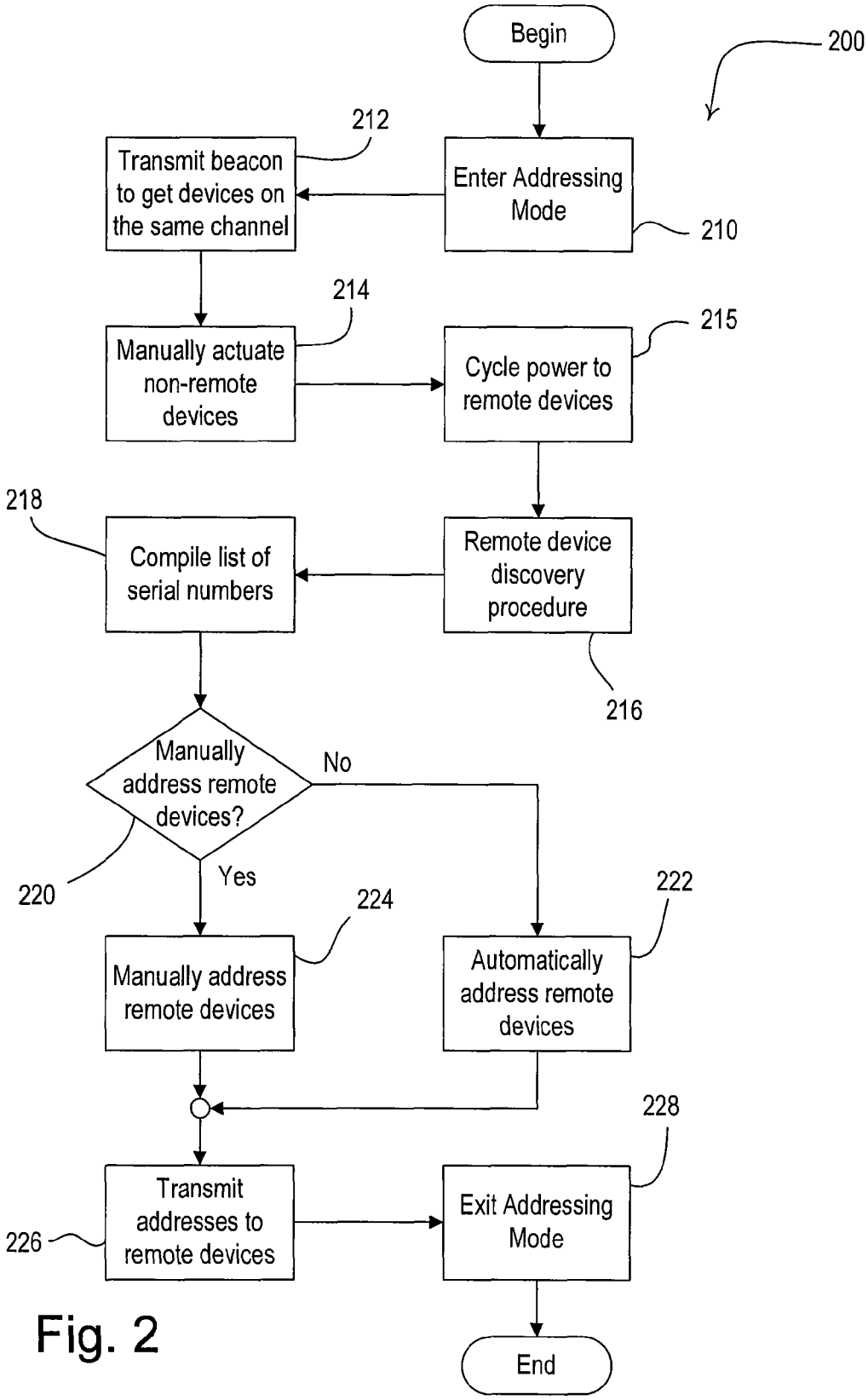
FIG. 2 is a flowchart of an addressing procedure for the RF lighting control system of FIG. 1 according to the present invention.

FIG. 2 is a flowchart of an addressing procedure 200 for the lighting control system 100 according to the present invention. The addressing procedure 200 is operable to assign device addresses to all of the control devices, including the remotely-located control devices, such as, for example, the remote dimming module 114 and the MWT control module 116. Each of the remote devices includes a number of flags that are utilized during the addressing procedure 200. The first flag is a POWER_CYCLED flag that is set when power has recently been cycled to the remote device. As used herein, "power cycling" is defined as removing power from a control device and then restoring power to the control device to cause the control device to restart or reboot. The second flag is a FOUND flag that is set when the remote device has been "found" by a remote device discovery procedure 216 to be described in greater detail below with reference to FIG. 4.

Prior to the start of the addressing procedure 200, the repeater 122 preferably selects an optimum one of the available channels on which to communicate. To find an optimum channel, the repeater 122 selects at random one of the available radio channels, listens to the selected channel, and decides whether the ambient noise on that channel is unacceptably high. If the received signal strength is greater than a noise threshold, the repeater 122 rejects the channel as unusable, and selects a different channel. Eventually, the repeater 122 determines the optimum channel for use during normal operation. The procedure to determine the optimum channel is described in greater detail in the '728 patent.

Figure 3A:
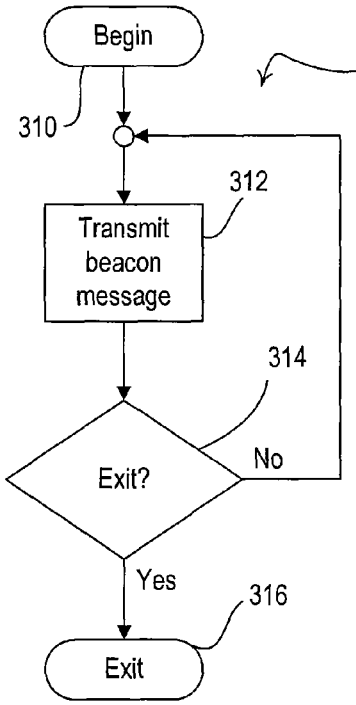
FIG. 3A is a flowchart of a first beacon process executed by a repeater of the lighting control system of FIG. 1 during the addressing procedure of FIG. 2.
Figure 3B:
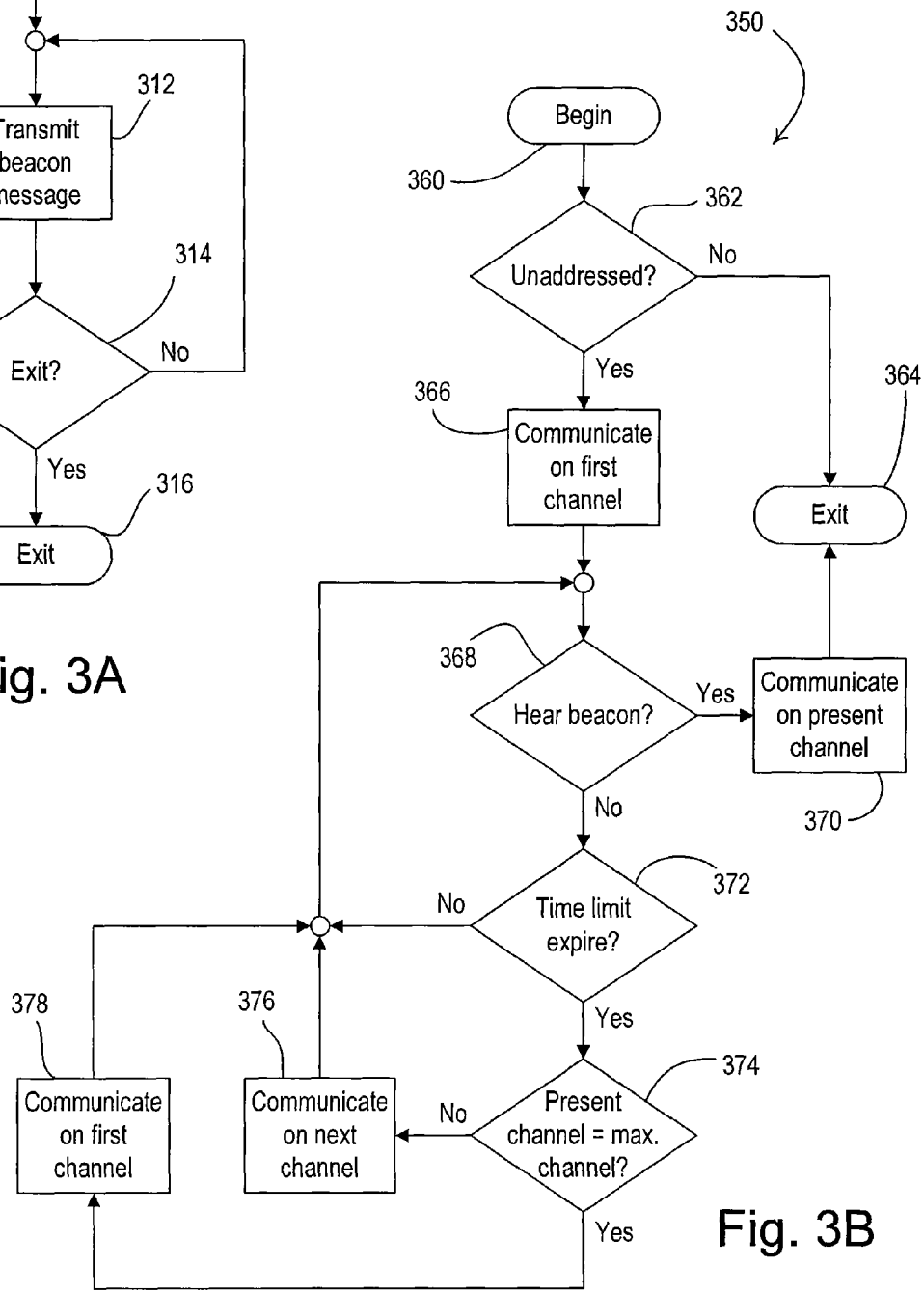
FIG. 3B is a flowchart of a second beacon process executed by a control device of the lighting control system of FIG. 1 at power up.

Referring to FIG. 2, the addressing procedure 200 begins when the lighting control system 100 enters an addressing mode at step 210, for example, in response to a user pressing and holding an actuator on the repeater 122 for a predetermined amount of time. Next, the repeater 122 begins repeatedly transmitting a beacon message to the control devices on the selected channel at step 212. Each of the control devices sequentially changes to each of the available channels to listen for the beacon message. Upon receiving the beacon message, the control devices begins to communicate on the selected channel. FIG. 3A is a flowchart of a first beacon process 300 executed by the repeater 122 during step 212. FIG. 3B is a flowchart of a second beacon process 350 executed by each of the control devices at power up, i.e., when power is first applied to the control device.

Referring to FIG. 3A, the first beacon process 300 begins at step 310. The repeater 122 transmits the beacon message at step 312. Specifically, the beacon message includes a command to "stay on my frequency", i.e., to begin transmitting and receiving RF signals on the selected channel. Alternatively, the beacon message could comprise another type of control signal, for example, a continuous-wave (CW) signal, i.e., to "jam" the selected channel. At step 314, if the user has not instructed the repeater 122 to exit the beacon process 300, e.g., by pressing and holding an actuator on the repeater for a predetermined amount of time, then the process continues to transmit the beacon message at step 312. Otherwise, the beacon process exits at step 316.

The second beacon process 350, which is executed by each of the control devices of the RF lighting control system 100 at power up, begins at step 360. If the control device has a unique device address at step 362, the process simply exits at step 364. However, if the control device is unaddressed at step 362, the control device begins to communicate on the first channel (i.e., to listen for the beacon message on the lowest available channel) and a timer is initialized to a constant $T_{MAX}$ and starts decreasing in value at step 366. If the control device hears the beacon message at step 368, the control device maintains the present channel as the communication channel at step 370 and exits the process at step 364.

Preferably, the control device listens for a predetermined amount of time (i.e., corresponding to the constant $T_{MAX}$ of the timer) on each of the available channels and steps through consecutive higher channels until the control device receives the beacon message. Preferably, the predetermined amount of time is substantially equal to the time required to transmit the beacon message twice plus an additional amount of time. For example, if the time required to transmit the beacon message once is approximately 140 msec and the additional amount of time is 20 msec, the predetermined amount of time that the control device listens on each channel is preferably 300 msec. Specifically, if the control device does not hear the beacon message at step 368, a determination is made as to whether the timer has expired at step 372. If the timer has not expired, the process loops until the timer has expired. At step 374, if the present channel is not equal to the maximum channel, i.e., the highest available channel, the control device begins to communicate on the next higher available channel and the timer is reset at step 376. Then, the control device listens for the beacon message once again at step 368. If the present channel is equal to the maximum channel at step 374, the control device begins to communicate again on the first channel and the timer is reset at step 378. Accordingly, the second beacon process 350 continues to loop until the control device receives the beacon message.

Referring back to FIG. 2, after the beacon process has finished at step 212, the user may manually actuate the non-remote devices, i.e., the wall-mounted dimmer 112 and the first and second wall-mounted master controls 118, 120, at step 214 (as in the addressing procedure of the prior art lighting control system disclosed in the '442 patent). In response to an actuation of a button, the non-remote devices transmit a signal associated with the actuation of the button to the repeater 122. Accordingly, the repeater 122 receives the signal, which is interpreted as a request for an address, and transmits the next available device address to the actuated non-remote control device.

Next, the remote control devices, i.e., the remote dimming module 114 and the MWT control module 116, are assigned device addresses. In order to prevent the inadvertent assignment of addresses to unaddressed devices in a neighboring RF lighting control system, e.g., an RF lighting control system installed within approximately 60 feet of the system 100, the user cycles power to all of the remote devices at step 215. For example, the user switches the first circuit breaker 124 to the open position in order to disconnect the source from the first power wiring 128, and then immediately switches the first circuit breaker back to the closed position to restore power.

Accordingly, the power provided to the remote dimming module 114 and the MWT control module 116 is cycled. Upon power-up, these remote devices set the POWER_CYCLED flag in memory to designate that power has recently been applied. Further, the remote devices begin to decrement a "power-cycled" timer. Preferably, the "power-cycled" timer is set to expire after approximately 10 minutes, after which the remote devices clear the POWER_CYCLED flag.

Figure 4:
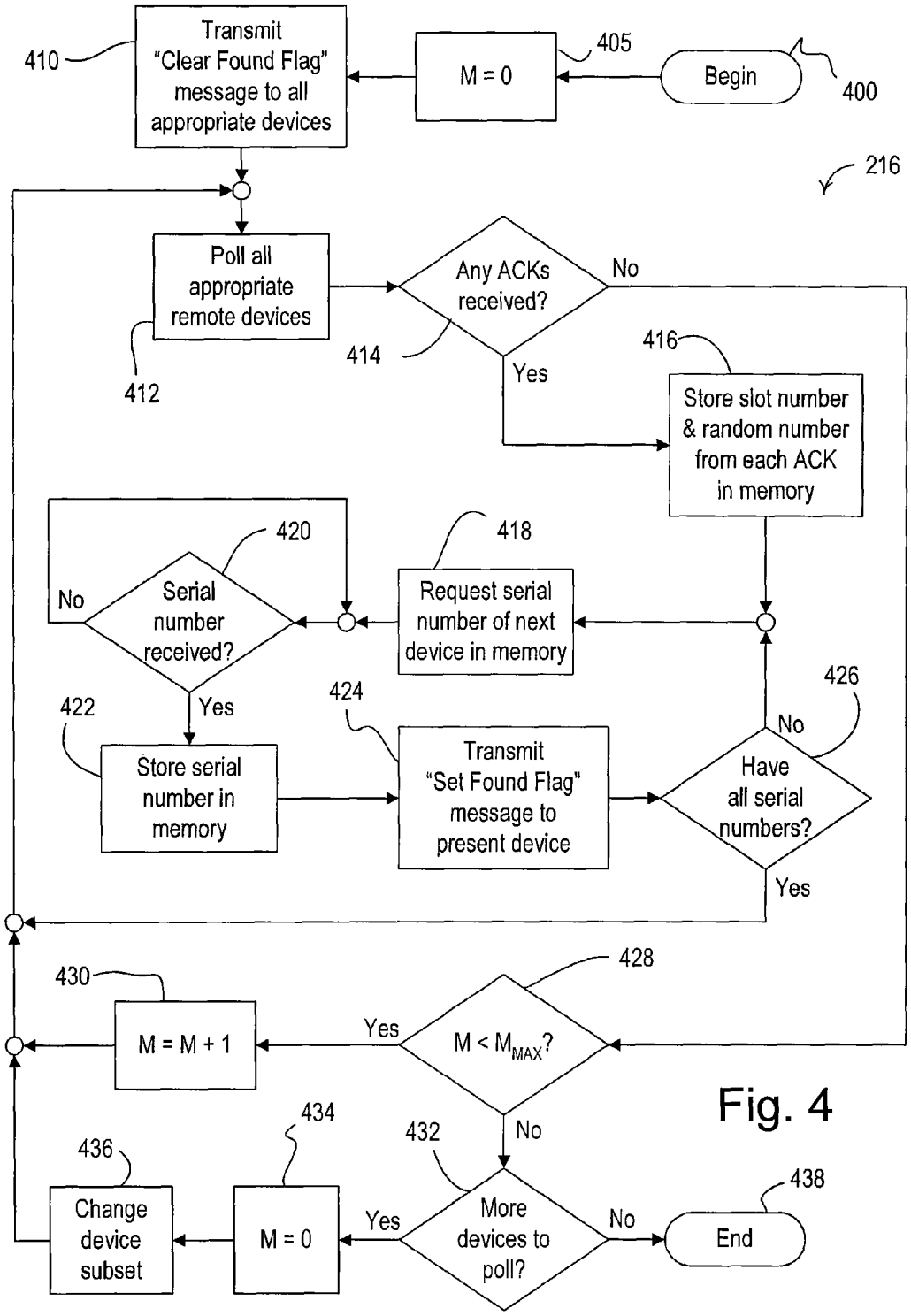
FIG. 4 is a flowchart of a remote device discovery procedure executed by the repeater of the RF lighting control system during the addressing procedure of FIG. 2.

After the power is cycled, the remote device discovery procedure 216, which is shown in FIG. 4, is executed by the repeater 122. The remote device discovery procedure 216 is performed on all "appropriate" control devices, i.e., those devices that are unaddressed, have not been found by the remote device discovery procedure (i.e., the FOUND flag is not set), and have recently had power cycled (i.e., the POWER_CYCLED flag is set). Accordingly, the remote device discovery procedure 216 must be completed before the "power-cycled" timer in each applicable control device expires.

Referring to FIG. 4, the remote device discovery procedure 216 begins at step 400. A variable M, which is used to determine the number of times that one of the control loops of the remote device discovery procedure 216 repeats, is set to zero at step 405. At step 410, the repeater 122 transmits a "clear found flag" message to all appropriate devices. When an unaddressed control device that has the POWER_CYCLED flag set receives the "clear found flag" message, the control device reacts to the message by clearing the FOUND flag. At step 412, the repeater 122 polls, i.e., transmits a query message to, a subset of the appropriate remote devices. The subset may be, for example, half of the appropriate remote devices, such as those unaddressed control devices that have not been found, have been recently power cycled, and have even serial numbers. The query message contains a request for the receiving control device to transmit an acknowledgement (ACK) message containing a random data byte in a random one of a predetermined number of ACK transmission slots, e.g., preferably, 64 ACK transmission slots. The appropriate remote devices respond by transmitting the ACK message, which includes a random data byte, to the repeater 122 in a random ACK transmission slot. At step 414, if at least one ACK message is received, the repeater 122 stores the number of the ACK transmission slot and the random data byte from each ACK message in memory at step 416.

Next, the repeater 122 transmits a "request serial number" message to each device that was stored in memory (i.e., each device having a random slot number and a random data byte stored in memory at step 416). Specifically, at step 418, the repeater transmits the message to the "next" device, e.g., the first device in memory when the "request serial number" message is transmitted for the first time. Since the repeater 122 has stored only the number of the ACK transmission slot and the associated random data byte for each device that transmitted an ACK message, the "request serial number" message is transmitted using this information. For example, the repeater 122 may transmit a "request serial number" message to the device that transmitted the ACK message in slot number 34 with the random data byte 0xA2 (hexadecimal). The repeater 122 waits to receive a serial number back from the device at step 420. When the repeater 122 receives the serial number, the serial number is stored in memory at step 422. At step 424, the repeater transmits a "set found flag" message to the present control device, i.e., to the control device having the serial number that was received at step 420. Upon receipt of the "set found flag" message, the remote device sets the FOUND flag in memory, such that the device no longer responds to query messages during the remote device discovery procedure 216. At step 426, if all serial numbers have not been collected, the process loops around to request the serial number of the next control device at step 418.

Since collisions might have occurred when the remote devices were transmitting the ACK message (at step 414), the same subset of devices is polled again at step 412. Specifically, if all serial numbers have been collected at step 426, the process loops around to poll the same subset of devices again at step 412. If no ACK messages are received at step 414, the process flows to step 428. If the variable M is less than a constant $M_{MAX}$ at step 428, the variable M is incremented at step 430. To ensure that all of the devices in the first subset have transmitted an ACK message to the query at step 412 without a collision occurring, the constant $M_{MAX}$ is preferably two (2) such that the repeater 122 preferably receives no ACK messages at step 414 in response to transmitting two queries at step 412. If the variable M is not less than the constant $M_{MAX}$ at step 428, then a determination is made at step 432 as to whether there are more devices to poll. If so, the variable M is set to zero at step 434 and the subset of devices (that are polled in step 412) is changed at step 436. For example, if the devices having even serial numbers were previously polled, the subset is changed to those devices having odd serial numbers. If there are no devices left to poll at step 432, the remote device discovery procedure exits at step 438.

Referring back to FIG. 2, at step 218, the repeater 122 compiles a list of serial numbers of all remote devices found in the remote device discovery procedure 216. At step 220, the user is presented with the option of either manually or automatically addressing the remote devices. If the user does not wish to manually address the remote devices, the remote devices are automatically assigned addresses in step 222, for example, sequentially in the order that the devices appear in the list of serial numbers of step 218. Otherwise, the user is able to manually assign addresses to the remote devices at step 224. For example, the user may use a graphical user interface (GUI) software provided on a personal computer (PC) that is operable to communicate with the RF lighting control system 100. Accordingly, the user can step through each device in the list of serial numbers and individually assign a unique address. After the remote devices are either automatically addressed at step 222, or manually addressed at step 224, the addresses are transmitted to the remote control devices at step 226. Finally, the user causes the lighting control system 100 to exit the addressing mode at step 228, e.g., by pressing and holding an actuator on the repeater 122 for a predetermined amount of time.

The step of cycling power to the remote devices, i.e., step 215, prevents unaddressed devices in a neighboring system from being addressed. The step of cycling power to the remote devices is very important when many RF lighting control systems are being concurrently installed in close proximity, such as in an apartment building or a condominium, and are being configured at the same time. Since two neighboring apartments or condominiums each have their own circuit breakers, the remote devices of each system can be separately power cycled. However, this step is optional since the user may be able to determine that the present lighting control system 100 is not located close to any other unaddressed RF lighting control systems. If the step of cycling power is omitted from the procedure 200, the repeater 122 polls all unaddressed devices at step 412 in the remote device discovery procedure 216 rather than polling only unaddressed devices that have been recently power cycled. Further, the step of cycling power need not occur after step 212, but could occur at any time before the remote device discovery procedure, i.e., step 216, is executed, as long the "power-cycled" timer has not expired.

Figure 5:
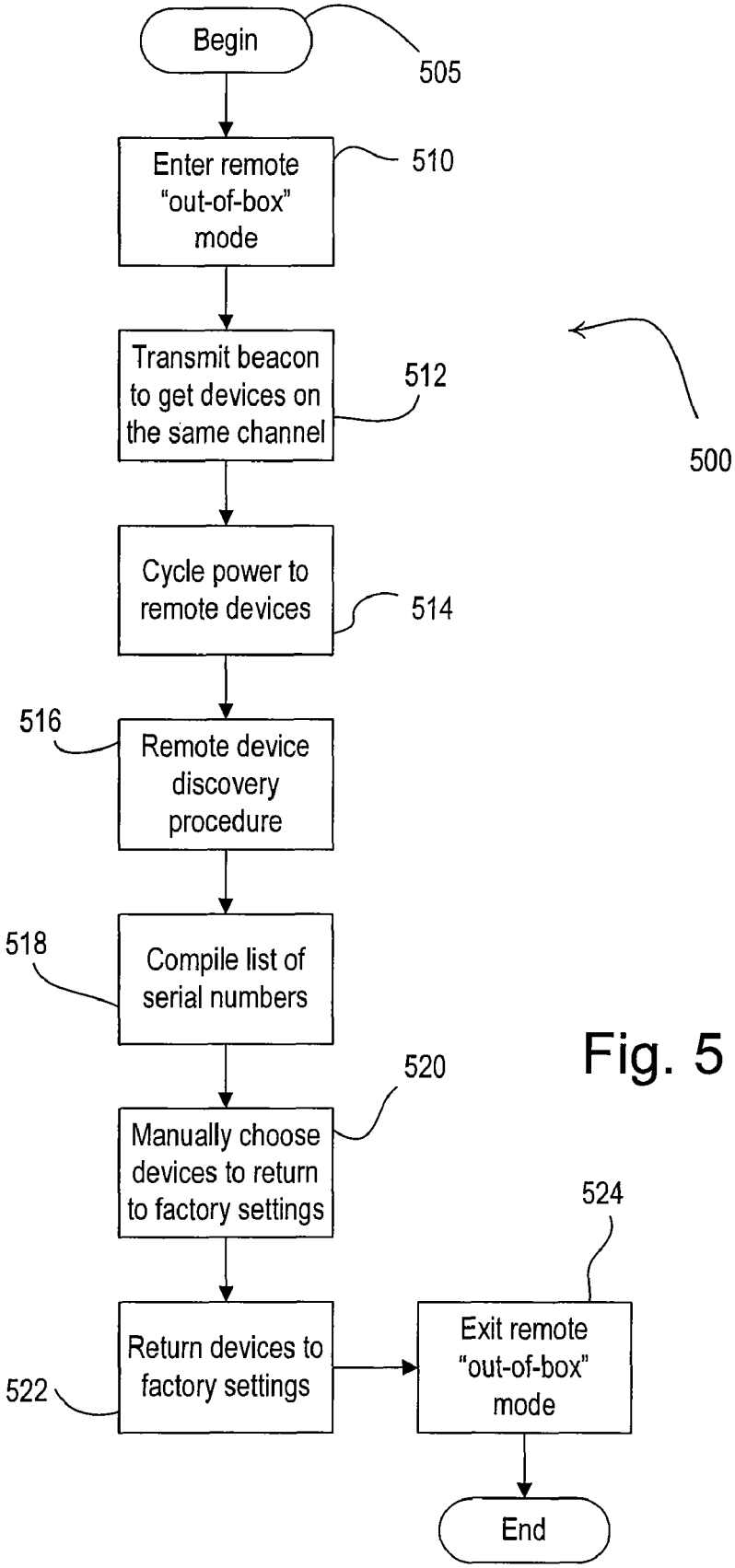
FIG. 5 is a flowchart of a remote "out-of-box" procedure for a control device of the RF lighting control system of FIG. 1 according to the present invention.

FIG. 5 is a flowchart of a remote "out-of-box" procedure 500 for a remotely-located control device of the lighting control system 100 according to the present invention. The remote "out-of-box" procedure 500 allows a user to return a remotely-located control device, i.e., the remote dimming module 114 or the MWT control module 116, to a default factory setting, i.e., an "out-of-box" setting. As in the addressing procedure 200, the control devices utilize the POWER_CYCLED flag and the FOUND flag during the "out-of-box" procedure 500.

The remote "out-of-box" procedure 500 begins at step 505 and the lighting control system 100 enters an "out-of-box" mode at step 510, for example, in response to a user pressing and holding an actuator on the repeater 122 for a predetermined amount of time. Next, the repeater 122 begins to transmit a beacon message to the control devices on the selected channel (i.e., the channel that is used during normal operation) at step 512. Specifically, the repeater 122 executes the first beacon process 300 of FIG. 3A. At step 514, the user cycles power to the specific control device that is to be returned to the "out-of-box" settings, for example, the remote dimming module 114. The user switches the first circuit breaker 124 to the open position in order to disconnect the source from the first power wiring 128, and then immediately switches the first circuit breaker back to the closed position to restore power to the remote dimming module 114. The step of power cycling prevents the user from inadvertently resetting a control device in a neighboring RF lighting control system to the "out-of-box" setting. Upon power-up, the remote control devices coupled to the first power wiring 128 set the POWER_CYCLED flag in memory to designate that power has recently been applied. Further, the remote devices begin to decrement a "power-cycled" timer. Preferably, the "power-cycled" timer is set to expire after approximately 10 minutes, after which the remote devices clear the POWER_CYCLED flag.

Figure 6:
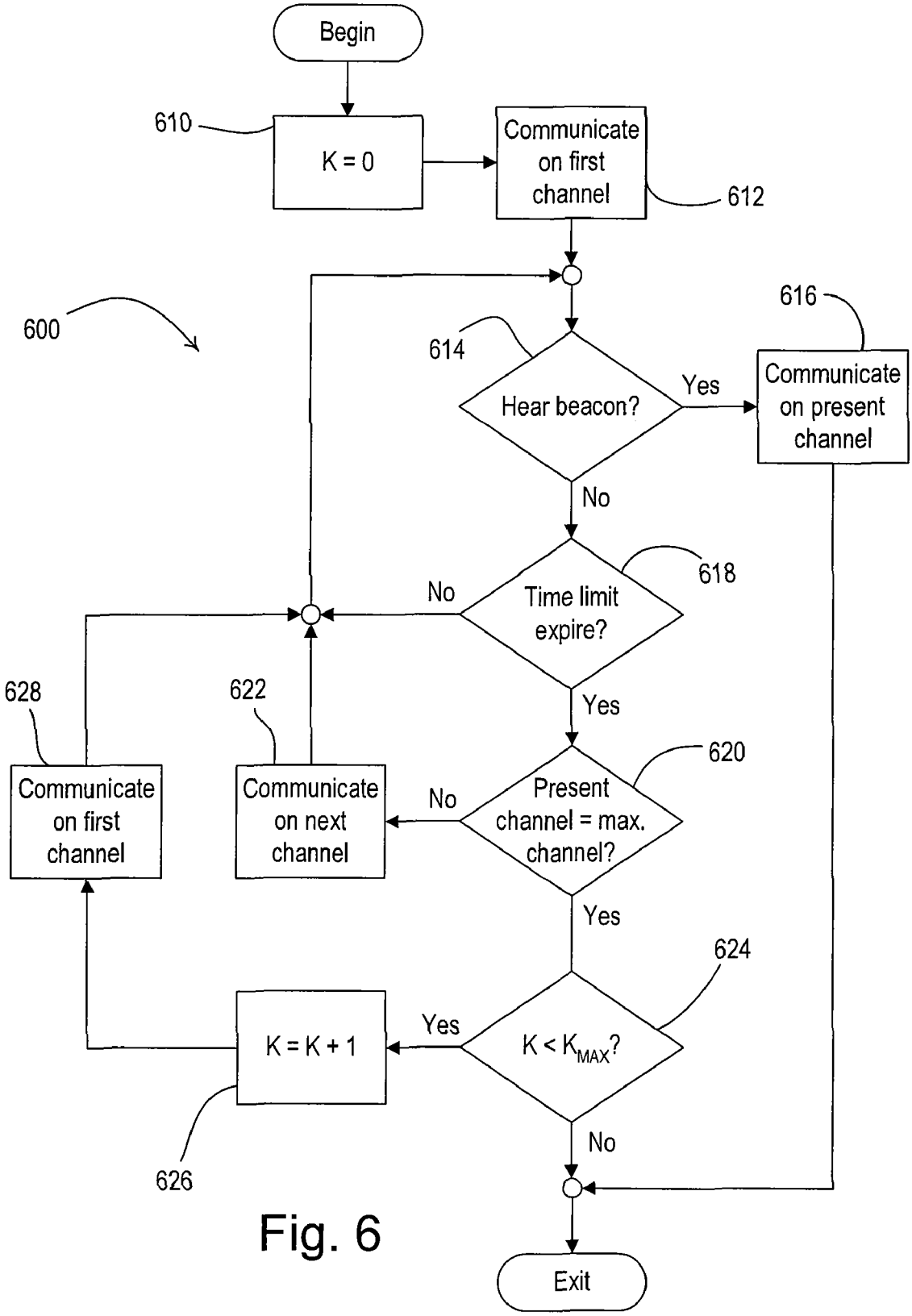
FIG. 6 is a flowchart of a third beacon procedure executed by a control device of the lighting control system of FIG. 1 at power up.

Next, the control devices coupled to the first power wiring 128, i.e., the devices that were power cycled, execute a third beacon procedure 600. FIG. 6 is a flowchart of the third beacon procedure 600. The third beacon process 600 is very similar to the second beacon process 350 of FIG. 3B and only the differences are noted below. First, no determination is made as to whether the control device is addressed or not (i.e., step 362 of FIG. 3A).

Further, the third beacon process 600 is prevented from looping forever as in the second beacon process 350, such that the control device is operable to return to normal operation if the control device does not hear the beacon message. To achieve this control, a variable K is used to count the number of times the control device cycles through each of the available channels listening for the beacon message. Specifically, the variable K is initialized to zero at step 610. At step 624, if the variable K is less than a constant $K_{MAX}$, the variable K is incremented and the control device begins to communicate on the first channel and the timer is reset at step 630. Accordingly, the control device listens for the beacon message on each of the available channels once again. However, if the variable K is not less than the constant $K_{MAX}$ at step 624, the third beacon process 600 exits at step 632. Preferably, the value of $K_{MAX}$ is two (2), such that the control device listens for the beacon message on each of the available channels twice.

In summary, after power is cycled to the desired control device at step 514, the control devices coupled to the first power wiring 128 execute the third beacon process 600. Thus, these control devices are operable to communicate on the selected channel.

Next, a remote device discovery procedure 516 is executed by the repeater 122. The remote device discovery procedure 516 is very similar to the remote device discovery procedure 216 shown in FIG. 4. However, the remote device discovery procedure 516 does not limit the devices that the procedure is performed on to only unaddressed devices (as with the remote device discovery procedure 216). The remote device discovery procedure 516 is performed on all control devices that have not been found by the remote device discovery procedure (i.e., the FOUND flag is not set) and have recently had power cycled (i.e., the POWER_CYCLED flag is set). The remote device discovery procedure 516 must be completed before the "power-cycled" timer in each applicable control device expires.

At step 518, the repeater 122 compiles a list of serial numbers of all remote devices found in the remote device discovery procedure 516. At step 520, the user may manually choose which of the control devices in the list are to be reset to the default factory settings, for example, by using a GUI software. Accordingly, the user can step through each control device in the list of serial numbers and individually decide which devices to restore to the "out-of-box" setting. Finally, the selected control devices are restored to the "out-of-box" setting at step 522 and the user causes the lighting control system 100 to exit the remote "out-of-box" mode at step 524, e.g., by pressing and holding an actuator on the repeater 122 for a predetermined amount of time.

While the present invention has been described with reference to an RF lighting control system, the procedures of the present invention could be applied to other types of lighting control system, e.g., a wired lighting control system, in order to establish communication with a remotely-located control device on a wired communication link using a desired channel.

Although the present invention has been described in relation to particular embodiments thereof, many other variations and modifications and other uses will be apparent to those skilled in the art. It is preferred, therefore, that the present invention be limited not by the specific disclosure herein, but only by the appended claims.

What is claimed is:

1. A method for configuring a radio frequency (RF) control device capable of receiving radio frequency messages on a plurality of radio frequency channels from a first device so as to receive messages transmitted by the first device on a designated one of the radio frequency channels, the method comprising the steps of:

repeatedly transmitting a beacon message on one of the channels from a beacon message transmitting device;

removing and subsequently restoring power to the control device;

initiating a beacon monitoring mode at the control device;

listening by the control device for the beacon message by scanning each of the plurality of radio frequency channels for a first predetermined period of time;

receiving the beacon message by the control device on one of the channels;

locking on by the control device to the channel on which the beacon message is received;

halting further scanning by the control device in response to the steps of receiving and locking on;

transmitting by the first device a query message to the control device; and transmitting by the control device a query message response if the control device receives the query message within a second predetermined period of time from when power was restored to the control device.

2. The method of claim 1, further comprising the step of:

transmitting from the first device an address message to the control device that assigns the control device a unique device address.

3. The method of claim 2, further comprising the steps of:

receiving the address message by the control device; and configuring the control device with the unique device address.

4. The method of claim 1, further comprising the step of:

determining at the first device an optimal radio frequency channel for transmitting the radio frequency messages.

5. The method of claim 4 , wherein the step of determining an optimal radio frequency channel comprises comparing the ambient noise level on one of the plurality of radio frequency channels to a noise threshold.

6. The method of claim 1, wherein the step of listening comprises sequentially monitoring at least some of the plurality of radio frequency channels each for the period of time until the beacon message is received.

7. The method of claim 1, further comprising the step of:

configuring the control device with a list of radio frequency channels to monitor for the beacon message.

8. The method of claim 1, wherein the first predetermined period of time is substantially equal to the time required to transmit the beacon message twice plus an additional amount of time.

9. The method of claim 1, wherein the control device is in an inaccessible location.

10. The method of claim 1, wherein the beacon message transmitting device is not the first device.

11. The method of claim 1, wherein the beacon message transmitting device is the first device.

12. The method of claim 1, wherein the control device, after the step of halting, waits for a command from the first device or executes one or more preprogrammed instructions.

13. The method of claim 1, further comprising the step of:

the first device transmitting an address message to the control device in response to the first device receiving the query message response from the control device, wherein the address message assigns the control device a unique device address.

* * * * *